US010453411B2

(12) United States Patent
Um et al.

(10) Patent No.: US 10,453,411 B2
(45) Date of Patent: Oct. 22, 2019

(54) DISPLAY DRIVING METHOD, DISPLAY PANEL AND DISPLAY DEVICE

(71) Applicant: BOE TECHNOLOGY GROUP CO., LTD., Beijing (CN)

(72) Inventors: Yoon Sung Um, Beijing (CN); Yu'e Jia, Beijing (CN); Kuanjun Peng, Beijing (CN); Yun Sik Im, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 134 days.

(21) Appl. No.: 15/529,777

(22) PCT Filed: Sep. 21, 2016

(86) PCT No.: PCT/CN2016/099578
§ 371 (c)(1),
(2) Date: May 25, 2017

(87) PCT Pub. No.: WO2017/118100
PCT Pub. Date: Jul. 13, 2017

(65) Prior Publication Data

US 2018/0082651 A1 Mar. 22, 2018

(30) Foreign Application Priority Data

Jan. 8, 2016 (CN) ..... 2016 1 0012208

(51) Int. Cl.
*G09G 3/36* (2006.01)

(52) U.S. Cl.
CPC ..... *G09G 3/3677* (2013.01); *G09G 3/3614* (2013.01); *G09G 3/3648* (2013.01);
(Continued)

(58) Field of Classification Search
CPC .. G09G 3/3614; G09G 3/3648; G09G 3/3677; G09G 2300/0426;
(Continued)

(56) References Cited

U.S. PATENT DOCUMENTS 9,024,853 B2 5/2015 Yu et al.
9,196,208 B2 11/2015 Dong et al.
(Continued)

FOREIGN PATENT DOCUMENTS

CN 1938748 A 3/2007
CN 101281336 A * 10/2008 ..... G02F 1/13624
(Continued)

OTHER PUBLICATIONS

Chinese Office Action in Chinese Application No. 201610012208.4, dated Aug. 2, 2017 with English translation.
(Continued)

*Primary Examiner* — Amare Mengistu
*Assistant Examiner* — Jennifer L Zubajlo
(74) *Attorney, Agent, or Firm* — Collard & Roe, P.C.

(57) ABSTRACT

A display driving method, a display panel and a display device. In the display driving method, the voltage (Vgl) of a gate turning-off signal at least changes once during the period of applying the gate turning-off signal to each gate line (Gate 1, Gate 2, . . . ). A pixel voltage signal is varied as the gate turning-off signal changes. Thus, the variation frequency of the pixel voltage signal within the display time of each frame is increased by changing the gate turning-off signal within the display time of each frame, which is equivalent to increase the refreshing frequency, so that the human eyes cannot recognize flicker.

17 Claims, 10 Drawing Sheets

(52) U.S. Cl.
CPC ..... *G09G 2300/0426* (2013.01); *G09G 2300/0823* (2013.01); *G09G 2310/08* (2013.01); *G09G 2320/0247* (2013.01)

(58) Field of Classification Search
CPC ..... G09G 2300/0823; G09G 2310/08; G09G 2320/0247
See application file for complete search history.

(56) References Cited

U.S. PATENT DOCUMENTS

| | | | | |
|---|---|---|---|---|
| 9,406,702 | B2 | 8/2016 | Wang | |
| 2004/0113879 | A1 | 6/2004 | Sekiguchi et al. | |
| 2007/0008441 | A1 | 1/2007 | Yoshihara et al. | |
| 2007/0188430 | A1 | 8/2007 | Moon | |
| 2009/0015529 | A1* | 1/2009 | Lai | G02F 1/13624 345/88 |
| 2017/0162166 | A1* | 6/2017 | Kang | G09G 3/3677 |

FOREIGN PATENT DOCUMENTS

| | | | | | |
|---|---|---|---|---|---|
| CN | 101281336 | A | | 10/2008 | |
| CN | 101520998 | A | | 9/2009 | |
| CN | 102568406 | A | | 7/2012 | |
| CN | 102879968 | A | | 1/2013 | |
| CN | 103186001 | A | | 7/2013 | |
| CN | 103744209 | A | | 4/2014 | |
| CN | 104298032 | A | * | 1/2015 | |
| CN | 104298032 | A | | 1/2015 | |
| CN | 104867473 | A | * | 8/2015 | G09G 3/3677 |
| CN | 104867473 | A | | 8/2015 | |
| CN | 104900201 | A | | 9/2015 | |
| CN | 104992690 | A | | 10/2015 | |
| CN | 105632437 | A | | 6/2016 | |
| KR | 10-2008-0054066 | A | | 6/2008 | |

OTHER PUBLICATIONS

International Search Report of PCT/CN2016/099578 in Chinese, dated Dec. 21, 2016 with English translation.
Notice of Transmittal of the International Search Report of PCT/CN2016/099578 in Chinese, dated Dec. 21, 2016.
Written Opinion of the International Searching Authority of PCT/CN2016/099578 in Chinese, dated Dec. 21, 2016 with English translation.
Second Chinese Office Action in Chinese Application No. 201610012208.4, dated Mar. 16, 2018 with English translation.

* cited by examiner

DISPLAY DRIVING METHOD, DISPLAY PANEL AND DISPLAY DEVICE

CROSS REFERENCE TO RELATED APPLICATIONS

This application is the National Stage of PCT/CN2016/099578 filed on Sep. 21, 2016, which claims priority under 35 U.S.C. § 119 of Chinese Application No. 201610012208.4 filed on Jan. 8, 2016, the disclosure of which is incorporated by reference.

TECHNICAL FIELD

The present disclosure relates to a display driving method, a display panel and a display device.

BACKGROUND

In the current display panels, liquid crystal display (LCD) panels have recently become important display panels due to the advantages such as low power consumption, high display quality, non-electromagnetic radiation, and wide application range.

In the display process of the LCD panel, when thin-film transistors (TFTs) connected with gate lines are switched from an on-state to an off-state, pixel voltage signals applied to pixel electrodes will be subjected to jump transition, so that the LCD panel can have flicker problem. In addition, as the voltages of the pixel voltage signals applied to the pixel electrodes when the TFTs are switched on in the current frame is unequal to the voltages of the pixel voltage signals applied to the pixel electrodes when the TFTs are switched off in the previous frame, the LCD panel will also suffer from the flicker problem. Moreover, the voltages of the pixel voltage signals applied to the pixel electrodes at different positions of the LCD panel has small difference due to the resistance of data lines, so the LCD panel will further suffer from the flicker problem.

SUMMARY

At least one embodiment of the present disclosure provides a display driving method, a display panel and a display device, which are used for solving the flicker problem of an LCD panel.

At least one embodiment of the present disclosure provides a display driving method, comprising: allowing a voltage of a gate turning-off signal to change at least once during a period of applying the gate turning-off signal to each gate line.

In an implementation example, in the method provided by at least one embodiment of the present disclosure, gate scanning signals are applied to gate lines within the display time of one frame, so that thin-film transistors (TFTs) electrically connected with the gate lines can be in an on-state; pixel voltage signals are applied to data lines; the pixel voltage signals are applied to pixel electrodes, electrically connected with the TFTs in the on-state, through the TFTs in the on-state; and a voltage of the pixel voltage signal is varied along with a change of the voltage of the gate turning-off signal, which satisfies a following expression:

$$\Delta V_P = \frac{C_{gs}}{C_{gs} + C_{st} + C_{lc}} \Delta V_{g1},$$

in which ΔVp represents a variation amount of the voltage of the pixel voltage signal; ΔVgl represents a variation amount of the voltage of the gate turning-off signal; Cgs represents the capacitance between a gate line and a source electrode in the TFT; Cst represents the capacitance between a pixel electrode and a common electrode line; and Clc represents the capacitance between the pixel electrode and a common electrode.

In an implementation example, in the method provided by at least one embodiment of the present disclosure, a moment or moments at which the voltage of the gate turning-off signal changes is or are configured to evenly divide the period of applying the gate turning-off signal.

In an implementation example, in the method provided by at least one embodiment of the present disclosure, a variation tendency of the voltage of the gate turning-off signal at each moment in a current frame is opposite to a variation tendency of the voltage of the gate turning-off signal at a corresponding moment in an adjacent frame.

In an implementation example, in the method provided by at least one embodiment of the present disclosure, the variation amount of the voltage of the gate turning-off signal at each moment in the current frame is equal to the variation amount of the voltage of the gate turning-off signal at a corresponding moment in the adjacent frame.

In an implementation example, in the method provided by at least one embodiment of the present disclosure, a frequency of applying the gate scanning signal to each gate line is 10 Hz-60 Hz.

In an implementation example, in the method provided by at least one embodiment of the present disclosure, pixel voltage signals with a same polarity are applied to pixel electrodes within display time of one frame; or pixel voltage signals with opposite polarities are applied to every two adjacent rows of pixel electrodes within the display time of one frame; or pixel voltage signals with opposite polarities are applied to every two adjacent columns of pixel electrodes within the display time of one frame; or pixel voltage signals with opposite polarities are applied to every two adjacent pixel electrodes within the display time of one frame.

At least one embodiment of the present disclosure provides a display panel, driven by any one of the above-mentioned display driving methods.

In an implementation example, the display panel provided by at least one embodiment of the present disclosure comprises: an array substrate and an opposing substrate arranged opposite to each other, and a plurality of TFTs disposed between the array substrate and the opposing substrate; the TFTs are oxide TFTs.

At least one embodiment of the present disclosure provides a display device, comprising the above-mentioned display panel.

DETAILED DESCRIPTION

Detailed description will be given below to the preferred embodiments of the display driving method, the display panel and the display device, provided by the embodiment of the present disclosure, with reference to the accompanying drawings.

For more clear understanding of the objectives, technical proposals and advantages of the present disclosure, more detailed description will be given below to the present disclosure with reference to the accompanying drawings. It is apparent that the described embodiments are only partial embodiments of the present disclosure but not all the embodiments. All the other embodiments obtained by those skilled in the art without creative efforts on the basis of the embodiments of the present disclosure shall fall within the scope of protection of the present disclosure.

Figure 1:
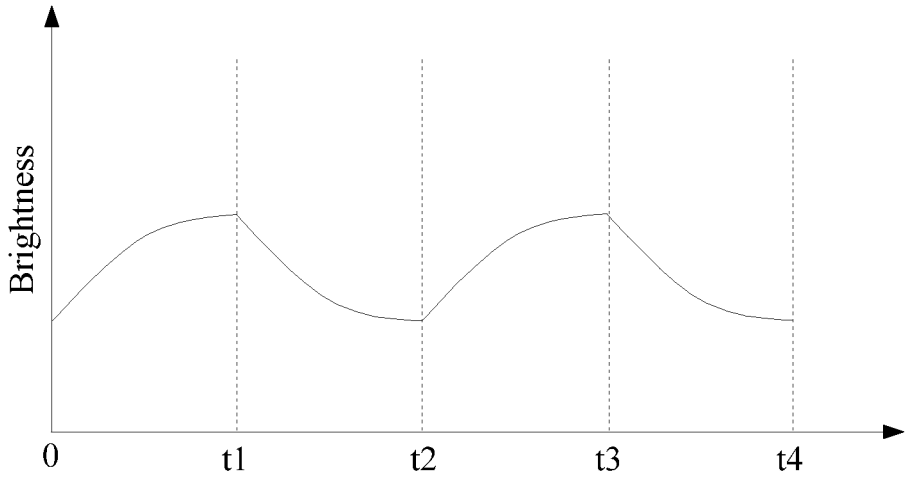
FIG. 1 is a curve diagram illustrating the change of the display brightness of a conventional LCD panel over time.

FIG. 1 is a curve diagram illustrating the change of the display brightness of the conventional LCD panel over time. As illustrated in FIG. 1 (0-t1, t1-t2, t2-t3 and t3-t4 are respectively the display time of one frame), the display brightness of an LCD panel with the refreshing frequency (namely the frequency of applying a gate scanning signal to each gate line) of 60 Hz changes significantly over time, so the flicker problem can be severe.

An embodiment of the present disclosure provides a display driving method, which comprises: allowing the voltage of a gate turning-off signal to change at least once during the period of applying the gate turning-off signal to each gate line.

In the display driving method provided by the embodiment of the present disclosure, the voltage of the gate turning-off signal at least changes once during the period of applying the gate turning-off signal to each gate line. A pixel voltage signal is varied as the gate turning-off signal changes. Thus, the variation frequency of the pixel voltage signal within the display time of each frame is increased by changing the gate turning-off signal within the display time of each frame, which is equivalent to improve the refreshing frequency, so that the human eyes cannot recognize flicker.

As a conventional display panel has severe flicker problem in the case of low refreshing frequency, the method provided by the embodiment of the present disclosure is particularly suitable for the display driving process with a low refreshing frequency (namely the frequency of applying the gate scanning signal to each gate line), for instance, particularly applicable to the display driving process with the refreshing frequency of 10 Hz-60 Hz. Of course, the method provided by the embodiment of the present disclosure is not limited to the refreshing frequency of 10 Hz-60 Hz. No limitation will be given here. Description is given in the following embodiments of the present disclosure by taking the refreshing frequency of 60 Hz as an example.

Figure 2A:
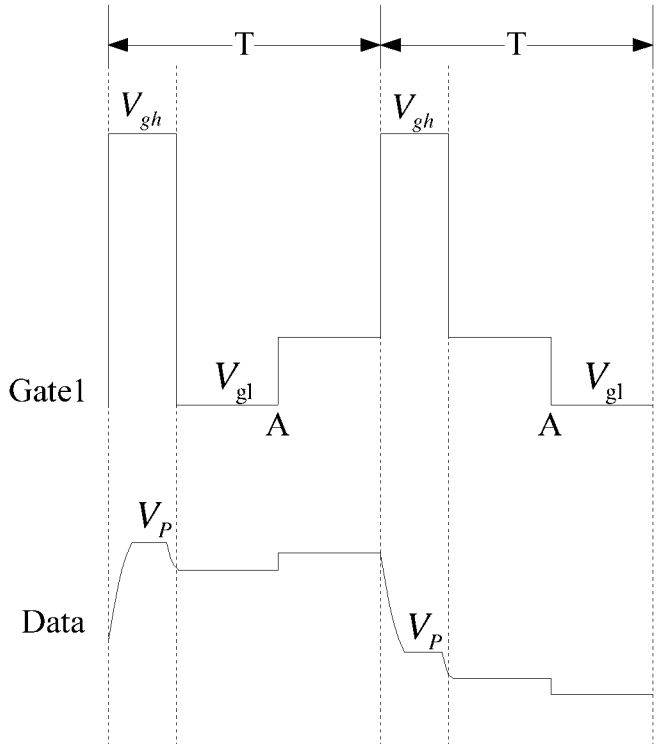
FIGS. 2*a* to 2*c* are respectively timing diagrams 1 of a display driving method provided by an embodiment of the present disclosure.
Figure 2B:
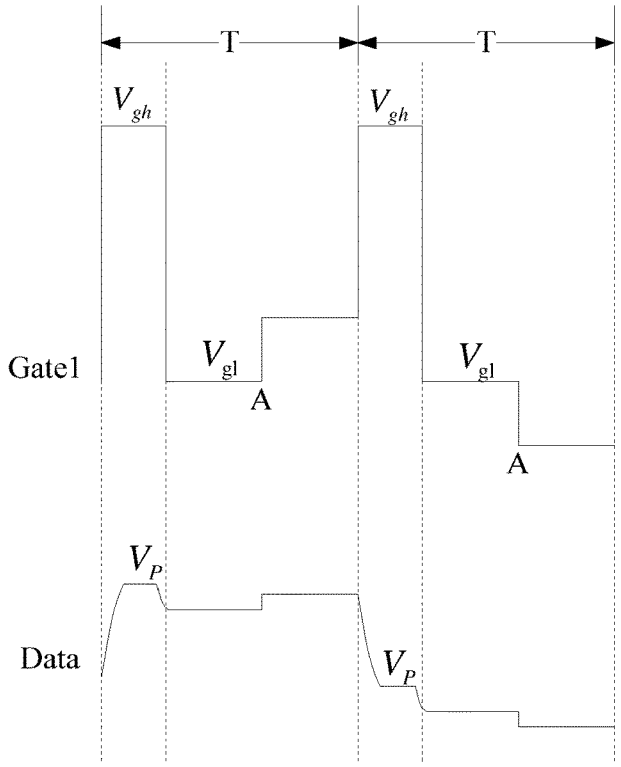
Figure 2C:
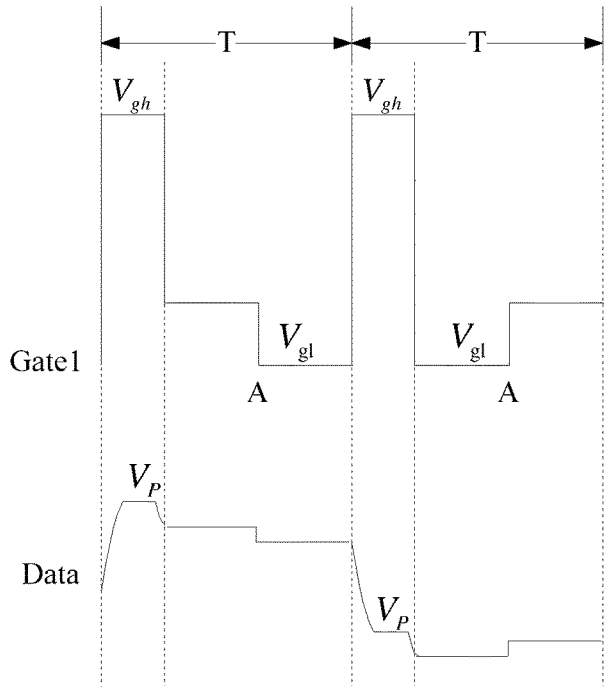
Figure 3A:
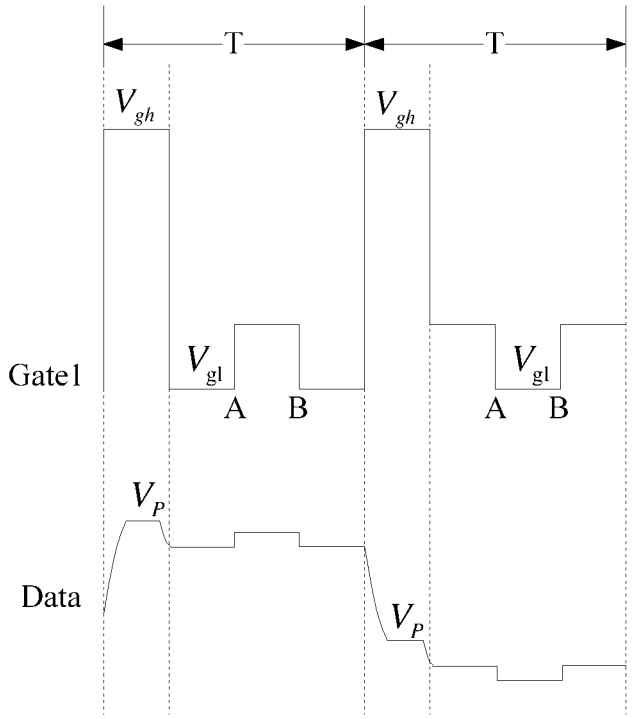
FIGS. 3*a* to 3*c* are respectively timing diagrams 2 of the display driving method provided by an embodiment of the present disclosure.
Figure 3B:
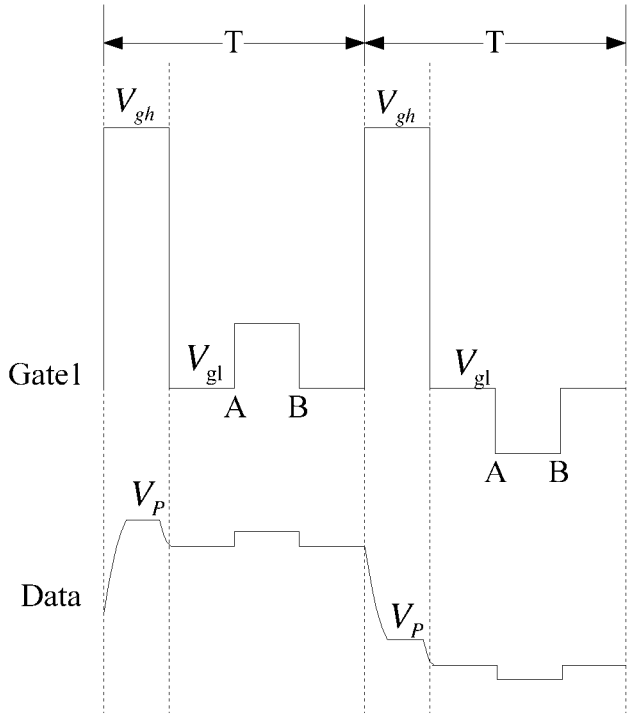
Figure 3C:
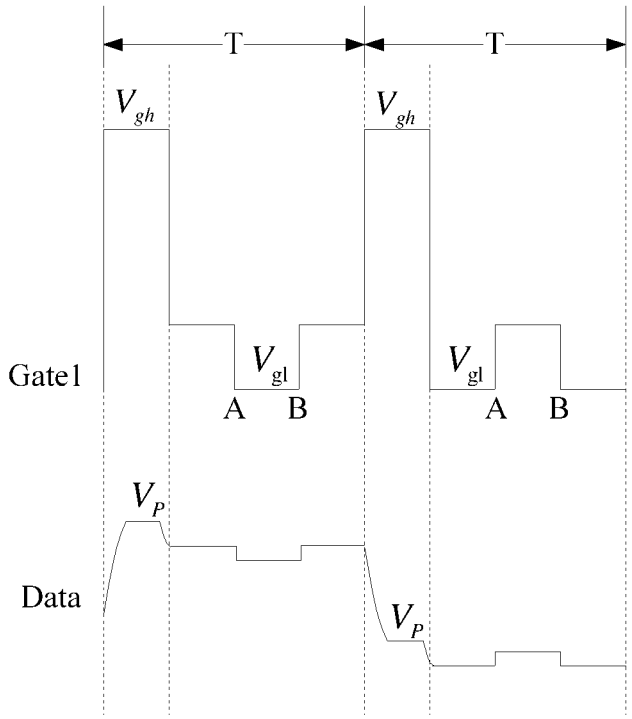
Figure 4A:
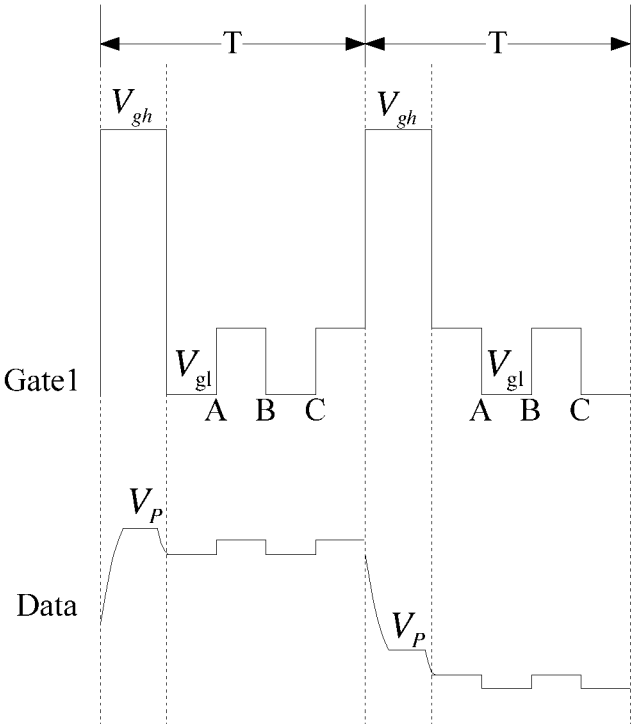
FIGS. 4*a* to 4*c* are respectively timing diagrams 3 of the display driving method provided by an embodiment of the present disclosure.
Figure 4B:
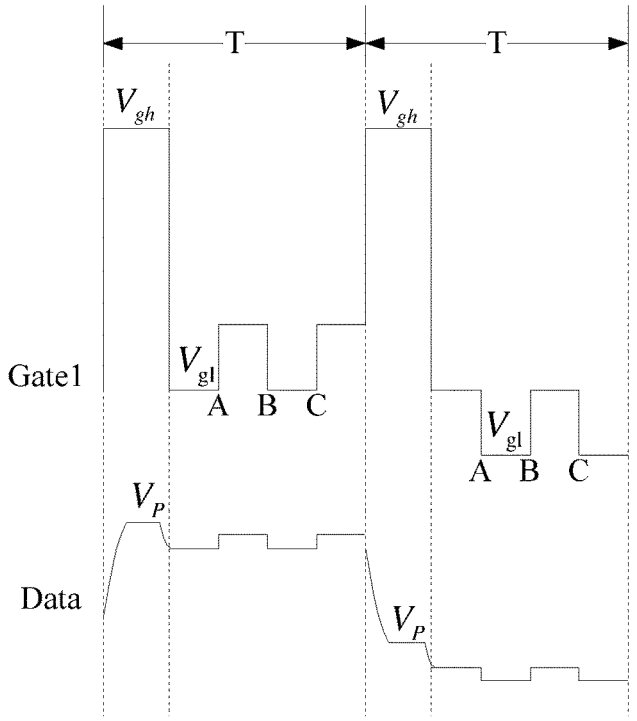
Figure 4C:
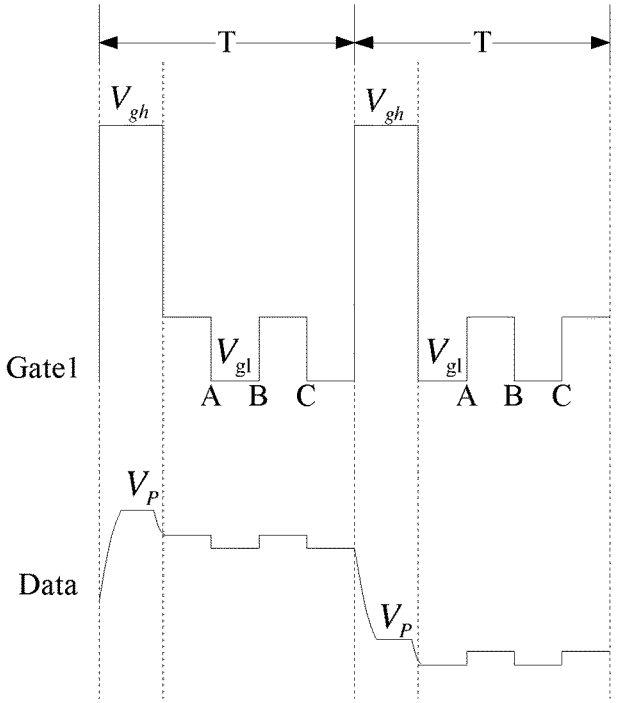
Figure 5:
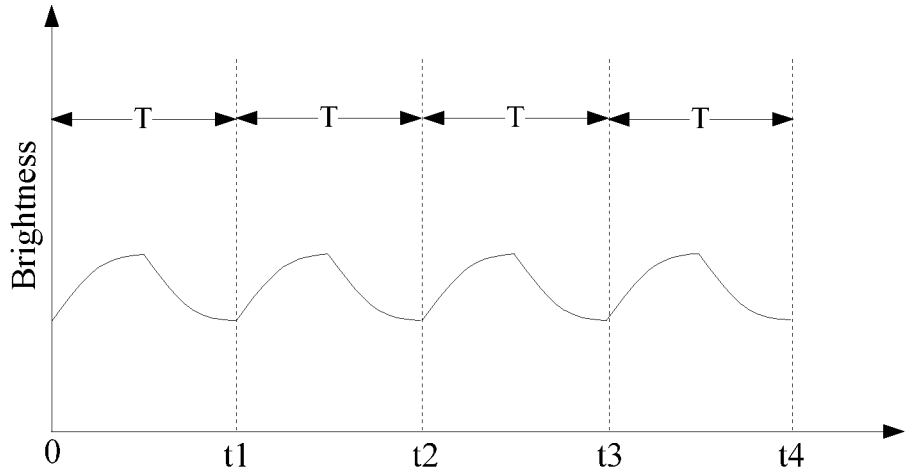
FIGS. 5 and 6 are respectively a curve diagram illustrating the change of the display brightness of an LCD panel, which employing the display driving method provided by an embodiment of the present disclosure, over time.
Figure 6:
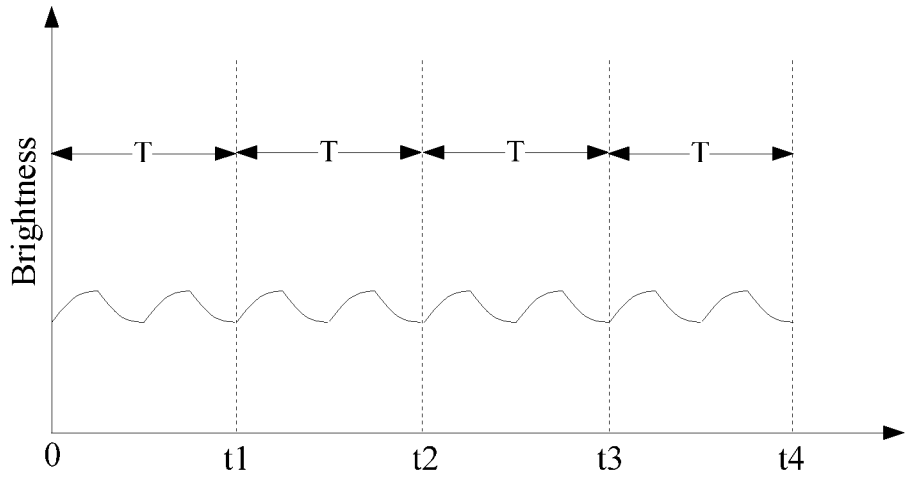

FIGS. 2*a* to 2*c*, FIGS. 3*a* to 3*c* and FIGS. 4*a* to 4*c* are respectively timing diagrams of the display driving method provided by the embodiment of the present disclosure. During implementation, in the method provided by an embodiment of the present disclosure, gate scanning signals are applied to gate lines Gate 1, Gate 2 . . . within the display time of one frame. As illustrated in FIGS. 2*a* to 2*c*, FIGS. 3*a* to 3*c* and FIGS. 4*a* to 4*c*, taking the gate line Gate 1 as an example, a gate turning-on signal and a gate turning-off signal are applied to the gate line Gate 1 within the display time of one frame T. Taking the case that the gate turning-on signal is a high level signal and the gate turning-off signal is a low level signal as an example, the voltage of the gate turning-on signal is Vgh and the voltage of the gate turning-off signal is Vgl. FIGS. 7*a* to 7*d* are respectively schematic diagrams illustrating the case that the display driving method provided by the embodiment of the present disclosure is applied in the modes of frame inversion, row inversion, column inversion and dot inversion. As illustrated in FIGS. 7*a* to 7*d*, a TFT 1 electrically connected with the gate line Gate 1 is in the on-state during the period of applying the gate turning-on signal to the gate line Gate 1. Pixel voltage signals are applied to data lines Data; the voltage of the pixel voltage signal is Vp; and the pixel voltage signal is applied to a pixel electrode 2 electrically connected with the TFT 1 in the on-state through the TFT 1 in the on-state. When the gate turning-on signal is converted into the gate turning-off signal, the voltage of the gate turning-off signal is subjected to jump transition once. When the voltage Vgl of the gate turning-off signal changes, the voltage Vp of the pixel voltage signal is varied along with the change Thus, the variation frequency of the pixel voltage signal within the display time of each frame can be increased by changing the gate turning-off signal within the display time of each frame, which is equivalent to improve the refreshing frequency, so that the human eyes cannot recognize flicker. FIGS. 5 and 6 are respectively curve diagrams illustrating the change of the display brightness of an LCD panel in the display driving method, provided by the embodiment of the present disclosure, over time. For instance, as illustrated in FIGS. 2*a* to 2*c*, the voltage of the gate turning-off signal changes once during the period of applying the gate turning-off signal to the gate line Gate 1, so that the variation frequency of the pixel voltage signal within the display time of one frame can be increased by one. As for the driving method with the refreshing frequency of 60 Hz, the display effect with the refreshing frequency of 120 Hz can be achieved (as illustrated in FIG. 5). Compared with the display effect as illustrated in FIG. 1, the amplitude of variation amount of the display brightness over time as illustrated in FIG. 5 is reduced, so the human eyes cannot recognize flicker. As illustrated in FIGS. 3*a* to 3*c*, the voltage of the gate turning-off signal changes twice during the period of applying the gate turning-off signal to the gate line Gate 1, so that the variation frequency of the pixel voltage signal within the display time of one frame can be increased by two. As for the driving method with the refreshing frequency of 60 Hz, the display effect with the refreshing frequency of 180 Hz can be achieved, so the human eyes cannot recognize flicker. As illustrated in FIGS. 4*a* to 4*c*, the voltage of the gate turning-off signal changes three times during the period of applying the gate turning-off signal to the gate line Gate 1, so that the variation frequency of the pixel voltage signal within the display time of one frame can be increased by three. As for the driving method with the refreshing frequency of 60 Hz, the display effect with the refreshing frequency of 240 Hz (as illustrated in FIG. 6) can be achieved. Compared with the display effect as illustrated in FIG. 1, the amplitude of variation amount of the display brightness over time as illustrated in FIG. 6 is further reduced, so the human eyes cannot recognize flicker.

During implementation, for instance, the variation amount ΔVp of the voltage of the pixel voltage signal and the variation amount ΔVgl of the voltage of the gate turning-off signal satisfy the following expression:

$$\Delta V_P = \frac{C_{gs}}{C_{gs} + C_{st} + C_{lc}} \Delta V_{g1},$$

in which ΔVp represents the variation amount of the voltage of the pixel voltage signal; ΔVgl represents the variation amount of the voltage of the gate turning-off signal; Cgs represents the capacitance between a gate line and a source electrode of a thin film transistor; Cst represents the capacitance between a pixel electrode and a common electrode line; and Clc represents the capacitance between the pixel electrode and a common electrode.

For instance, in the method provided by an embodiment of the present disclosure, as illustrated in FIGS. 2*a* to 2*c*, FIGS. 3*a* to 3*c* and FIGS. 4*a* to 4*c*, the moment(s) at which the voltage Vgl of the gate turning-off signal changes may be configured to evenly divide the period for applying the gate turning-off signal. Thus, as for the same gate line, the time point, at which the pixel voltage signal applied in each frame changes, is the same and is the most suitable. For instance, as illustrated in FIGS. 2*a* to 2*c*, the voltage Vgl of the gate turning-off signal changes once during the period of applying the gate turning-off signal to the gate line Gate 1, and the moment A at which Vgl changes evenly divides the period of applying the gate turning-off signal into two periods; as illustrated in FIGS. 3*a* to 3*c*, the voltage Vgl of the gate turning-off signal changes twice during the period of applying the gate turning-off signal to the gate line Gate 1, and the moments A and B at which Vgl changes evenly divide the period of applying the gate turning-off signal into three periods; and as illustrated in FIGS. 4*a* to 4*c*, the voltage Vgl of the gate turning-off signal changes three times during the period of applying the gate turning-off signal to the gate line Gate 1, and moments A, B and C at which Vgl changes evenly divide the period of applying the gate turning-off signal into four periods.

Moreover, in the method provided by an embodiment of the present disclosure, as illustrated in FIGS. 2*a* to 2*c*, FIGS. 3*a* to 3*c* and FIGS. 4*a* to 4*c*, the variation tendency of the voltage Vgl of the gate turning-off signal at each moment in the current frame may be opposite to the variation tendency at a corresponding moment in an adjacent frame. Thus, as for the same gate line, the variation tendencies of the pixel voltage signals, applied in two adjacent frames, at corresponding moments are opposite, so that the display effect can be optimized. For instance, as illustrated in FIGS. 2*a* and 2*b*, the voltage Vgl of the gate turning-off signal is increased at the moment A in the first frame, and reduced at the moment A in the second frame; as illustrated in FIG. 2*c*, the voltage Vgl of the gate turning-off signal is reduced at the moment A in the first frame, and increased at the moment A in the second frame; as illustrated in FIGS. 3*a* and 3*b*, the voltage Vgl of the gate turning-off signal is increased at the moment A and reduced at the moment B in the first frame, and reduced at the moment A and increased at the moment B in the second frame; as illustrated in FIG. 3*c*, the voltage Vgl of the gate turning-off signal is reduced at the moment A and increased at the moment B in the first frame, and increased at the moment A and reduced at the moment B in the second frame; as illustrated in FIGS. 4*a* and 4*b*, the voltage Vgl of the gate turning-off signal is increased at the moment A, reduced at the moment B and increased at the moment C in the first frame, and reduced at the moment A, increased at the moment B and reduced at the moment C in the second frame; and as illustrated in FIG. 4*c*, the voltage Vgl of the gate turning-off signal is reduced at the moment A, increased at the moment B and reduced at the moment C in the first frame, and increased at the moment A, reduced at the moment B and increased at the moment C in the second frame.

For instance, in the method provided by an embodiment of the present disclosure, as illustrated in FIGS. 2*a* to 2*c*, FIGS. 3*a* to 3*c* and FIGS. 4*a* to 4*c*, the variation amount of the voltage Vgl of the gate turning-off signal at each moment in the current frame is equal to the variation amount of the voltage Vgl of the gate turning-off signal at a corresponding moment in an adjacent frame. Thus, as for the same gate line, the pixel voltage signals applied to two adjacent frames can be symmetrical, so that the display effect can be optimized.

Figure 7A:
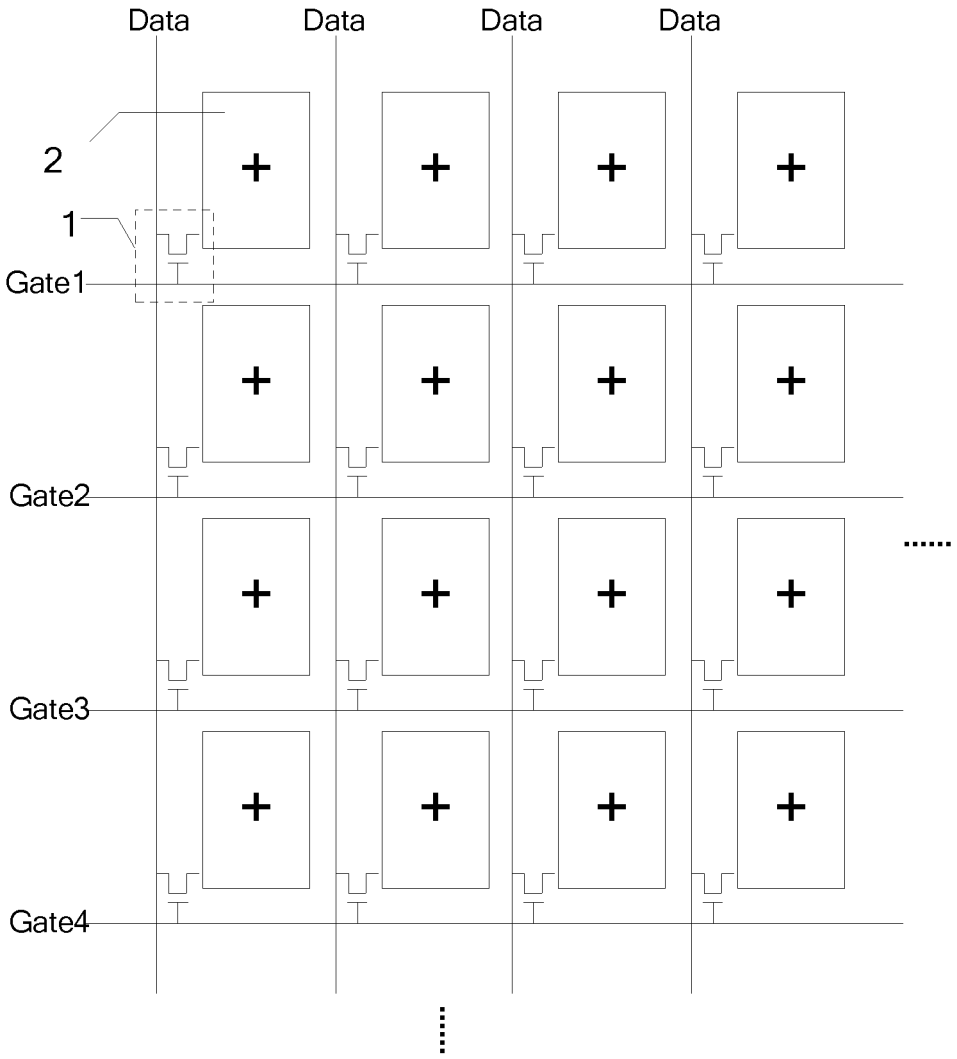
FIGS. 7*a* to 7*d* are respectively schematic diagrams illustrating the case that the display driving method provided by an embodiment of the present disclosure is applied in the modes of frame inversion, row inversion, column inversion and dot inversion.
Figure 7B:
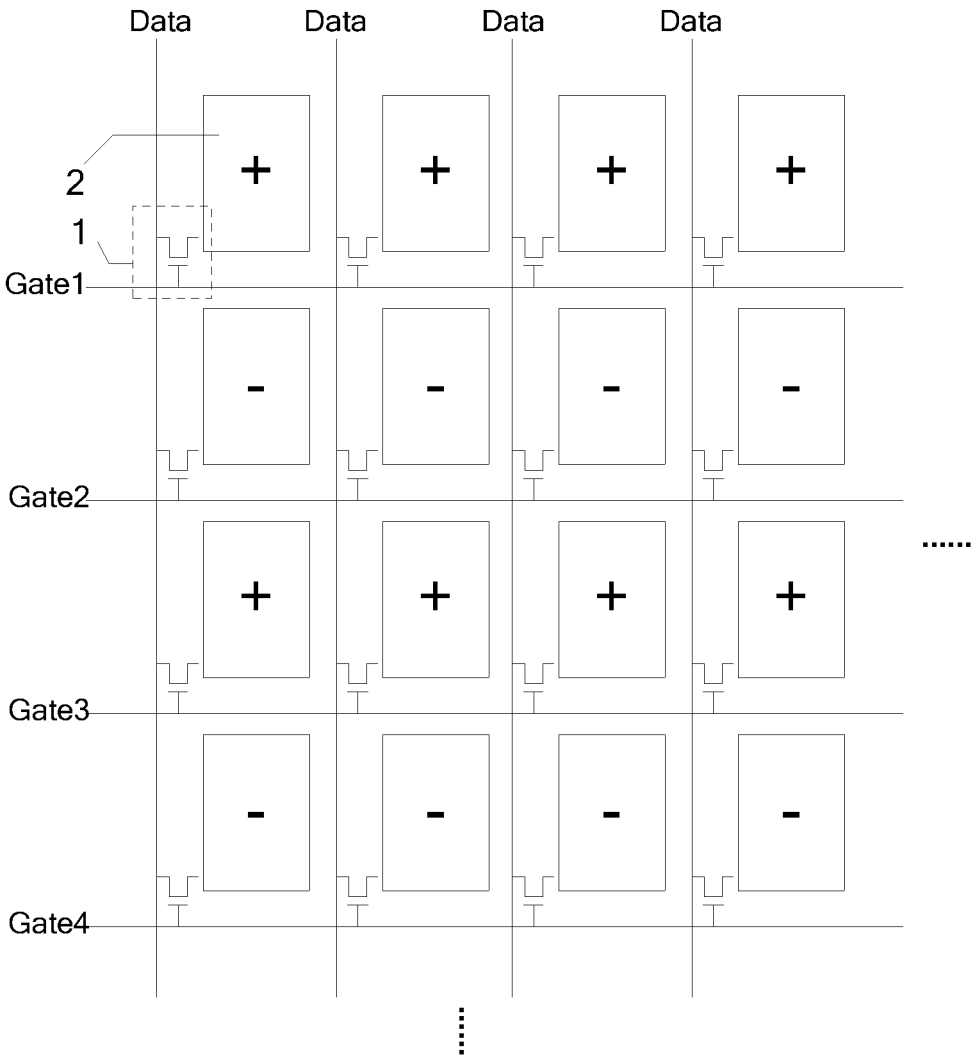
Figure 7C:
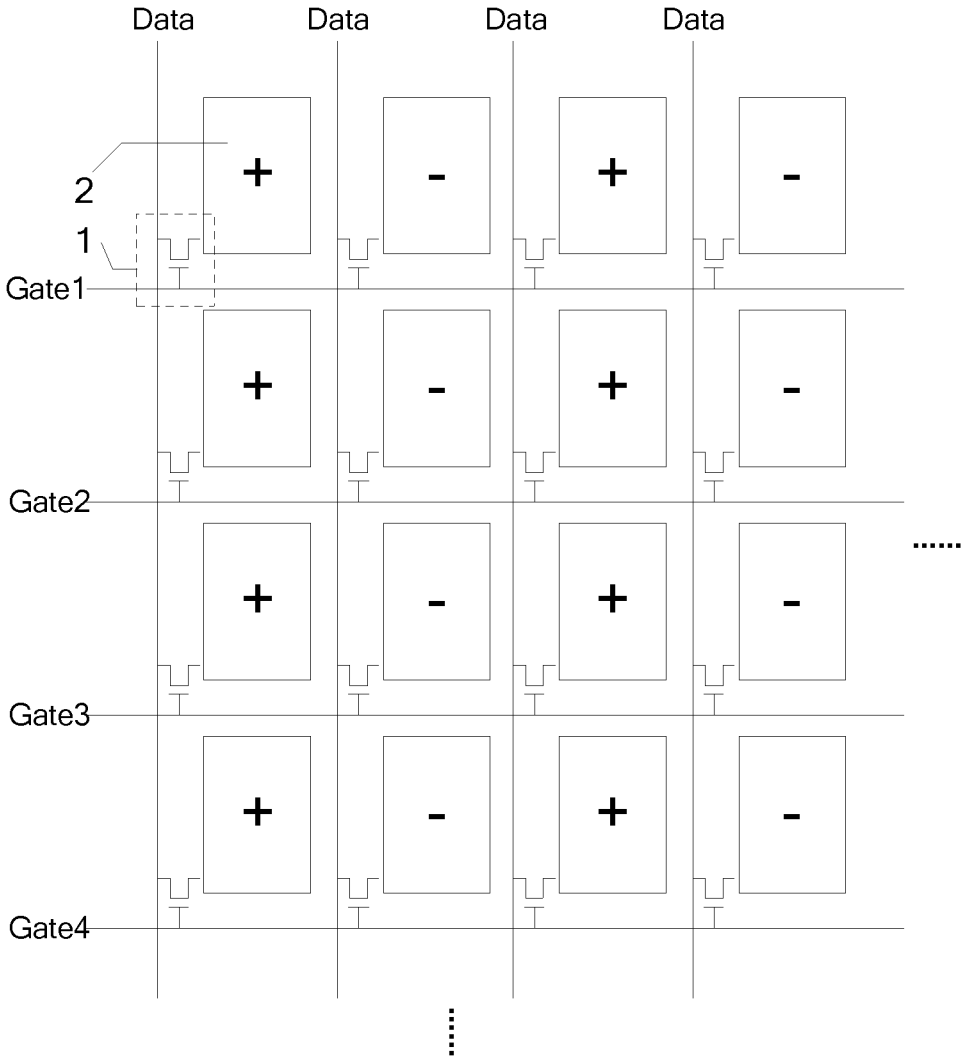
Figure 7D:
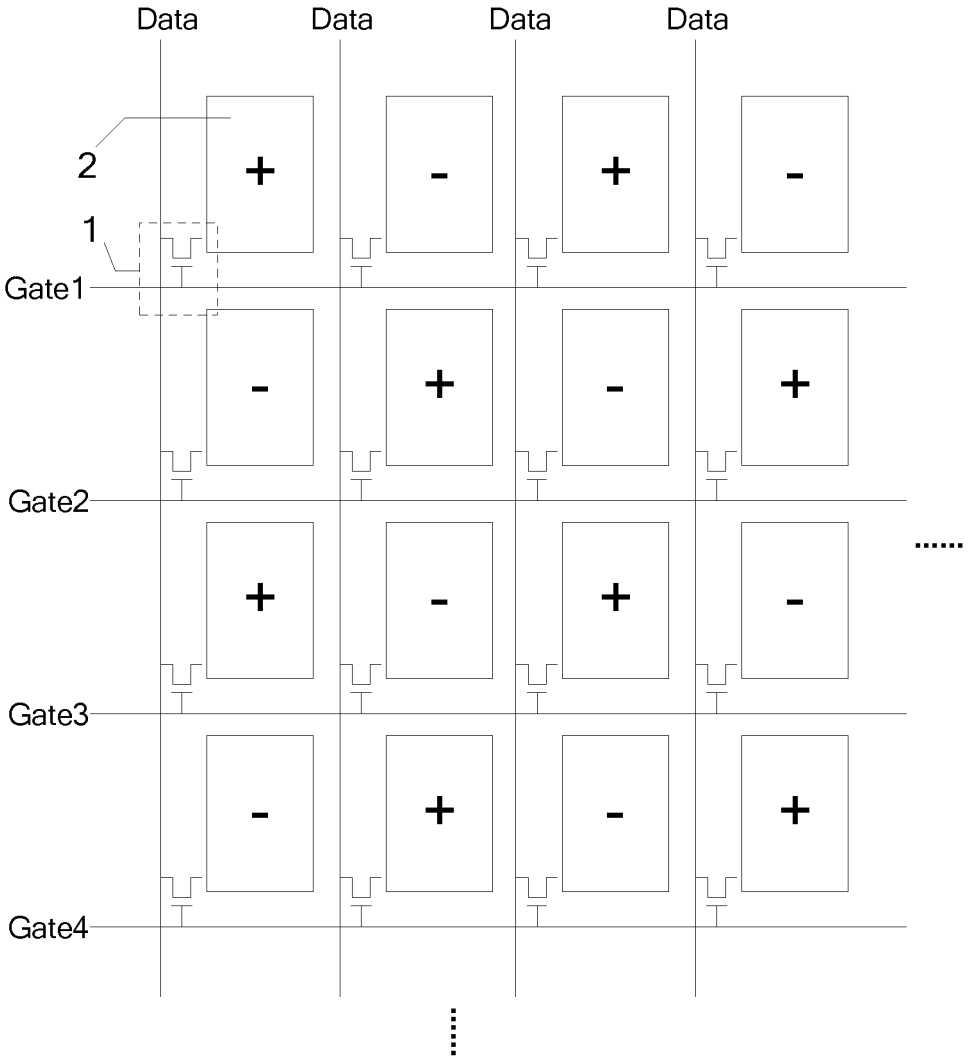

During implementation, the method provided by an embodiment of the present disclosure may be applicable to the frame-inversion driving mode, namely pixel voltage signals with the same polarity are applied to all the pixel electrodes within the display time of one frame. For instance, as illustrated in FIG. 7*a*, pixel voltage signals with the positive polarity are applied to all the pixel electrodes 2 in the current frame. Alternatively, the method provided by an embodiment of the present disclosure may be applicable to the row-inversion driving mode, namely pixel voltage signals with opposite polarities are applied to every two adjacent rows of pixel electrodes within the display time of one frame. For instance, as illustrated in FIG. 7*b*, pixel voltage signals with the positive polarity are applied to the odd rows of pixel electrodes 2 in the current frame, and pixel voltage signals with the negative polarity are applied to the even rows of pixel electrodes 2. Alternatively, the method provided by an embodiment of the present disclosure may be applicable to the column-inversion driving mode, namely pixel voltage signals with opposite polarities are applied to every two adjacent columns of pixel electrodes within the display time of one frame. For instance, as illustrated in FIG. 7*c*, pixel voltage signals with the positive polarity are applied to the odd columns of pixel electrodes 2 in the current frame, and pixel voltage signals with the negative polarity are applied to the even columns of pixel electrodes 2. Alternatively, the method provided by an embodiment of the present disclosure may be applicable to the dot-inversion driving mode, namely pixel voltage signals with opposite polarities are applied to every two adjacent pixel electrodes. For instance, as illustrated in FIG. 7*d*, pixel voltage signals applied to any two adjacent pixel electrodes 2 in the current frame have opposite polarities. No limitation will be given to the disclosure here.

On the basis of the same inventive concept, an embodiment of the present disclosure further provides a display panel, which is driven by the display driving method provided by an embodiment of the present disclosure. The embodiments of the display panel may refer to the embodiments of the display driving method. No further description will be given here.

During implementation, the display panel provided by an embodiment of the present disclosure may comprise: an array substrate and an opposing substrate arranged opposite to each other, and a plurality of TFTs disposed between the array substrate and the opposing substrate, wherein the TFTs may be oxide TFTs, or the TFTs may also be amorphous silicon (a-Si) TFTs. No limitation will be given to the disclosure here. It should be noted that the TFTs may be oxide TFTs, and the reason is that the leakage current Ioff, when the oxide TFTs are in the off-state, varies little when the voltage Vgl of the gate turning-off signal changes, and the leakage current Ioff of the oxide TFTs is basically not affected by the voltage Vgl of the gate turning-off signal, so that the case that the characteristics of the TFTs are affected by the change of the voltage Vgl of the gate turning-off signal can be avoided, and hence the display effect cannot be affected.

Based on the same inventive concept, an embodiment of the present disclosure further provides a display device, which comprises the display panel provided by the embodiments of the present disclosure. The display device may be: any product or component with display function such as a mobile phone, a tablet PC, a TV, a display, a notebook computer, a digital picture frame, a navigator or the like. The embodiments of the present disclosure may refer to the embodiments of the display panel. No further description will be given here.

Embodiments of the present disclosure provide a display driving method, a display panel and a display device. In the display driving method, the voltage of a gate turning-off signal at least changes once during the period of applying the gate turning-off signal to each gate line. The pixel voltage signal is varied as the gate turning-off signal changes. Thus, the variation frequency of the pixel voltage signal within the display time of each frame is increased by changing the gate turning-off signal within the display time of each frame, which is equivalent to increase the refreshing frequency, so that the human eyes cannot recognize flicker.

It is apparent that various modifications and deformations may be made to the present disclosure by those skilled in the art without departing from the spirit and the scope of the present disclosure. Therefore, if the modifications and the deformations of the present disclosure fall within the scope of the claims of the present disclosure and equivalent technologies thereof, the present disclosure is also intended to include the modifications and the deformations.

The application claims priority to the Chinese patent application No. 201610012208.4, filed Jan. 8, 2016, the entire disclosure of which is incorporated herein by reference as part of the present application.

What is claimed is:

1. A display driving method, comprising:

allowing a voltage of a gate turning-off signal to change at least once during a period of applying the gate turning-off signal to each gate line, wherein gate scanning signals are applied to gate lines within the display time of one frame, so that thin-film transistors (TFTs) electrically connected with the gate lines can be in an on-state; pixel voltage signals are applied to data lines; the pixel voltage signals are applied to pixel electrodes, electrically connected with the TFTs in the on-state, through the TFTs in the on-state; and as for one pixel electrode connected to one TFT which is connected to one gate line in turn, a voltage of the pixel voltage signal applied to the one pixel electrode is varied along with a change of the voltage of the gate turning-off signal applied to the one gate line, which satisfies a following expression:

$$\Delta V_P = \frac{C_{gs}}{C_{gs} + C_{st} + C_{lc}} \Delta V_{g1},$$

in which ΔVp represents a variation amount of the voltage of the pixel voltage signal; ΔVgl represents a variation amount of the voltage of the gate turning-off signal; Cgs represents the capacitance between a gate line and a source electrode in the one TFT; Cst represents the capacitance between the pixel electrode and a common electrode line; and Clc represents the capacitance between the pixel electrode and a common electrode.

2. The method according to claim 1, wherein a moment or moments at which the voltage of the gate turning-off signal changes is or are configured to evenly divide the period of applying the gate turning-off signal.

3. The method according to claim 2, wherein a variation tendency of the voltage of the gate turning-off signal at each moment in a current frame is opposite to a variation tendency of the voltage of the gate turning-off signal at a corresponding moment in an adjacent frame.

4. The method according to claim 2, wherein a frequency of applying the gate scanning signal to each gate line is 10 Hz-60 Hz.

5. The method according to claim 2, wherein pixel voltage signals with a same polarity are applied to pixel electrodes within display time of one frame; or pixel voltage signals with opposite polarities are applied to every two adjacent rows of pixel electrodes within the display time of one frame; or pixel voltage signals with opposite polarities are applied to every two adjacent columns of pixel electrodes within the display time of one frame; or pixel voltage signals with opposite polarities are applied to every two adjacent pixel electrodes within the display time of one frame.

6. The method according to claim 3, wherein the variation amount of the voltage of the gate turning-off signal at each moment in the current frame is equal to the variation amount of the voltage of the gate turning-off signal at a corresponding moment in the adjacent frame.

7. The method according to claim 3, wherein a frequency of applying the gate scanning signal to each gate line is 10 Hz-60 Hz.

8. The method according to claim 3, wherein pixel voltage signals with a same polarity are applied to pixel electrodes within display time of one frame; or pixel voltage signals with opposite polarities are applied to every two adjacent rows of pixel electrodes within the display time of one frame; or pixel voltage signals with opposite polarities are applied to every two adjacent columns of pixel electrodes within the display time of one frame; or pixel voltage signals with opposite polarities are applied to every two adjacent pixel electrodes within the display time of one frame.

9. The method according to claim 6, wherein a frequency of applying the gate scanning signal to each gate line is 10 Hz-60 Hz.

10. The method according to claim 6, wherein pixel voltage signals with a same polarity are applied to pixel electrodes within display time of one frame; or pixel voltage signals with opposite polarities are applied to every two adjacent rows of pixel electrodes within the display time of one frame; or pixel voltage signals with opposite polarities are applied to every two adjacent columns of pixel electrodes within the display time of one frame; or pixel voltage signals with opposite polarities are applied to every two adjacent pixel electrodes within the display time of one frame.

11. The method according to claim 1, wherein a frequency of applying the gate scanning signal to each gate line is 10 Hz-60 Hz.

12. The method according to claim 1, wherein pixel voltage signals with a same polarity are applied to pixel electrodes within display time of one frame; or pixel voltage signals with opposite polarities are applied to every two adjacent rows of pixel electrodes within the display time of one frame; or pixel voltage signals with opposite polarities are applied to every two adjacent columns of pixel electrodes within the display time of one frame; or pixel voltage signals with opposite polarities are applied to every two adjacent pixel electrodes within the display time of one frame.

13. A display panel, driven by the display driving method according to claim 1.

14. The display panel according to claim 13, comprising: an array substrate and an opposing substrate arranged opposite to each other, and a plurality of TFTs disposed between the array substrate and the opposing substrate.

15. A display device, comprising the display panel according to claim 13.

16. The display device according to claim 15, wherein the display panel comprises: an array substrate and an opposing substrate arranged opposite to each other, and a plurality of TFTs disposed between the array substrate and the opposing substrate.

17. The display device according to claim 16, wherein the TFTs are oxide TFTs.

* * * * *